US005313692A

United States Patent [19]

Mizuuchi et al.

[11] Patent Number: 5,313,692

[45] Date of Patent: May 24, 1994

[54] WARP YARN BREAKAGE DETECTING SYSTEM

[75] Inventors: Sotoo Mizuuchi, Kanazawa; Isao Nishimura, Kahoku, both of Japan

[73] Assignee: Tsudakoma Kogyo Kabushiki Kaisha, Kanazawa, Japan

[21] Appl. No.: 7,772

[22] Filed: Jan. 22, 1993

[30] Foreign Application Priority Data

Jan. 24, 1992 [JP] Japan ..... 4-032833
Jun. 19, 1992 [JP] Japan ..... 4-048734[U]

[51] Int. Cl.[5] ..... D03D 51/28

[52] U.S. Cl. ..... 28/187; 139/353; 356/430

[58] Field of Search ..... 28/187, 185; 139/353; 250/562; 356/430

[56] References Cited

U.S. PATENT DOCUMENTS 3,447,213 6/1969 Dost ..... 28/187
3,765,777 10/1973 Williams, Jr. ..... 28/187 X
4,911,207 3/1990 Gryson et al. ..... 139/353

FOREIGN PATENT DOCUMENTS 50-25860 3/1975 Japan .
50-25861 3/1975 Japan .
51-35759 3/1976 Japan .

*Primary Examiner*—Andrew M. Falik
*Attorney, Agent, or Firm*—Wenderoth, Lind & Ponack

[57] ABSTRACT

A yarn breakage detecting system includes yarn detectors for detecting warp yarns forming a warp and for providing yarn detection signals, and a signal processing unit for counting peaks in the yarn detection signals, representing the warp yarns and for providing a yarn breakage detection signal when the number of peaks is smaller than a predetermined number. The warp yarns are divided into a plurality of groups and the adjacent groups are spaced apart by a predetermined distance greater than the pitches of the warp yarns in the groups by spacers or demarcated by identifiers, and the yarn detectors are respectively assigned to the groups of warp yarns. Since the monitoring range of each yarn detector is relatively narrow, the yarn detector can accurately detect the warp yarns at a high resolution in a relatively short time.

28 Claims, 12 Drawing Sheets

WARP YARN BREAKAGE DETECTING SYSTEM

BACKGROUND OF THE INVENTION

Field of the Invention

Yarn breakage detecting systems disclosed in Japanese Laid-Open Patent (Kokai) Application Nos. 50-25860, 51-35759 and 50-25861 (cited references 1, 2 and 3, respectively) detect the number of warp yarns forming a warp and determine that yarn breakage has occurred when the number of the warp yarns is smaller than a predetermined number. The yarn breakage detecting systems disclosed in the cited references 1 and 2 employ a fixed yarn detector which is held fixedly, and the yarn breakage detecting system disclosed in the cited reference 3 employs a moving yarn detector which moves along the warp.

The disadvantages of these prior art yarn breakage detecting systems are exposed when the prior art yarn breakage detecting systems are applied to detecting the breakage of warp yarns of a wide warp. First, the fixed yarn detector is incapable of accurately detecting the warp yarns in the opposite ends of the warp remote from the yarn detector and hence the yarn breakage detecting system is unable to count the number of warp yarns accurately, because the virtual pitches of the warp yarns remote from the fixed yarn detector as viewed from the fixed yarn detector are small and the fixed yarn detector is unable to distinguish individual warp yarns separately.

The moving yarn detector requires a relatively long time to scan all the warp yarns and hence the yarn breakage detecting system is unable to detect the breakage of a warp yarn as soon as it is broken. Consequently, it is possible for serious problems to occur, such as the additional breakage of warp yarns caused by the broken warp yarn and the winding of the broken warp yarn on the cloth beam. The yarn breakage detecting system employing the fixed yarn detector has similar disadvantages.

Such disadvantages may be overcome by dividing the width of the warp into a plurality of monitoring ranges and allocating a plurality of yarn detectors respectively to the plurality of monitoring ranges. Such a means, however, entails other problems; that is, since the warp yarns swing to make the boundaries of the monitoring ranges indistinct and the yarn detectors vibrate and are unable to detect the numbers of the warp yarns in the corresponding monitoring ranges accurately, it is impossible to count the number of the warp yarns accurately. Accordingly, it is impossible to apply such a means to practical use.

SUMMARY OF THE INVENTION

Accordingly, it is a first object of the present invention to provide a yarn breakage detecting system capable of accurately and quickly detecting broken warp yarns and of correctly counting the number of warp yarns.

This object can be achieved by a yarn breakage detecting system comprising a plurality of yarn detectors capable of photoelectrically detecting warp yarns and assigned respectively to a plurality of groups of warp yarns formed by dividing a warp with respect to the width thereof and demarcated by identifiers or spaces of a predetermined width formed between the adjacent groups of warp yarns.

Each of warp yarn detectors detects the warp yarns of the corresponding group and generates an electric detection signal having peaks corresponding to the warp yarns. The peaks included in the electric detection signal are counted to determine the number of wrap yarns.

Since a warp is divided into the plurality of groups of warp yarns demarcated by the identifiers or the spaces of a predetermined width, and the warp yarn detectors are assigned respectively to the plurality of groups of warp yarns, each warp yarn detector is able to detect the warp yarns of the corresponding group accurately and quickly, and restrictions are not placed on the possible range of detection and resolution of the warp yarn detectors, and the number of warp yarns of the warp can be accurately counted, and the breakage of the warp yarns can be quickly detected.

When dividing a warp into a plurality of groups of warp yarns spaced by spacing pins it is impossible to determine spaces between the warp yarns in which spacing pins are to be disposed, because the spacing pins are arranged at equal pitches and have no marker. Therefore, the spacing pins are counted from one end of the width of the warp to determine positions for the spacers, which is troublesome and requires much time.

Accordingly, it is a second object of the present invention to facilitate the determination of the positions of the spacing pins, the detection of yarn breakage and the location of the broken warp yarn.

This object can be achieved by a yarn spacer having a plurality of spacing pins for spacing warp yarns, including some special demarcating pins which can be visually discriminated from the rest of the spacing pins. These special demarcating pins enable simple discrimination of a plurality of groups of warp yarns.

Since the yarn spacer has the spacing pins including special demarcating pins differing in shape from the other spacing pins, the warp yarns of the warp can be easily divided into groups, and a broken warp yarn can be easily located since the range of existence thereof can be clearly demarcated when the breakage of the warp yarn is detected by the yarn breakage detecting system.

BRIEF DESCRIPTION OF THE DRAWINGS

The above and other objects, features and advantages of the present invention will become more apparent from the following description taken in connection with the accompanying drawings, in which:

FIG. 1(*a*) is a block diagram of the signal processor 6 of FIG. 1;

DESCRIPTION OF THE PREFERRED EMBODIMENT

First Embodiment

Figure 1:
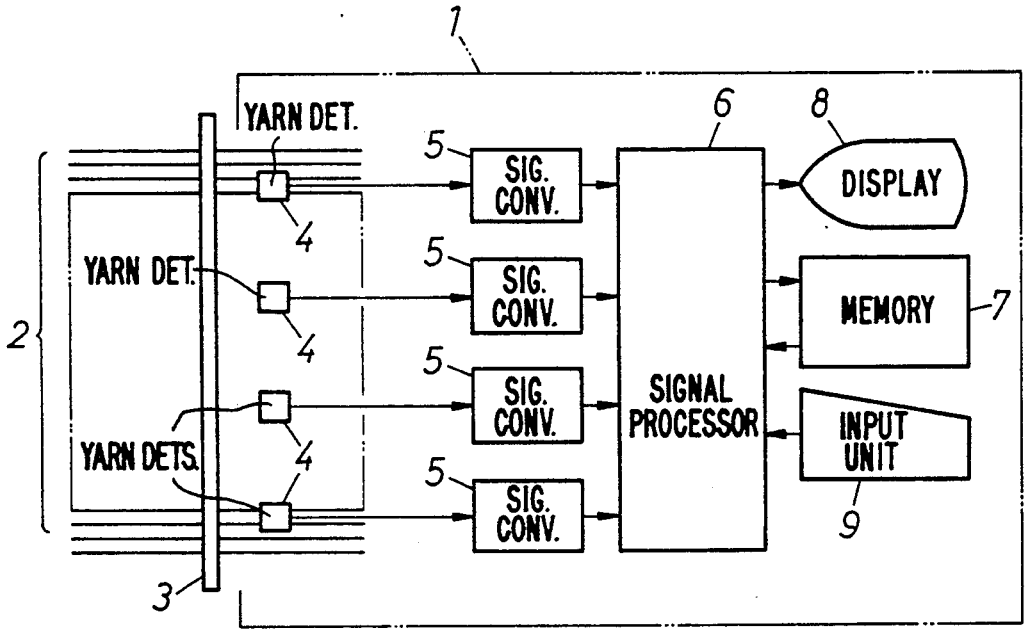
FIG. 1 is block diagram of a yarn breakage detecting system in a preferred embodiment according to the present invention.
Figure 1A:
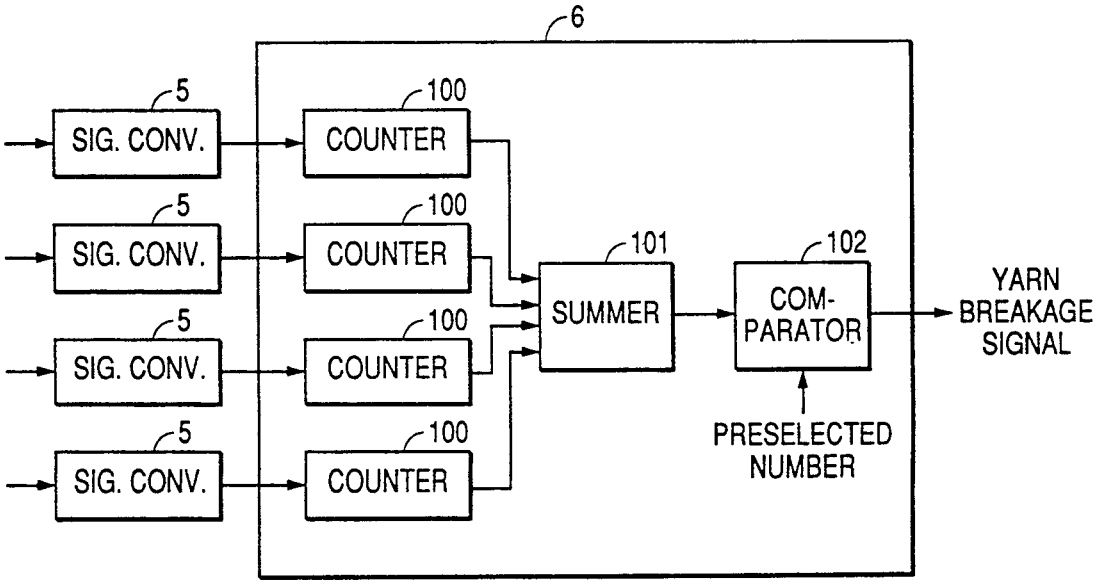
Figure 2A:
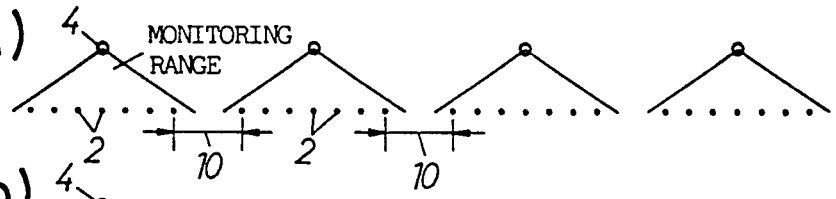
FIGS. 2(*a*) to 2(*d*) are diagrams of assistance in explaining a method of dividing warp yarns of a warp into a plurality of groups.
Figure 2B:
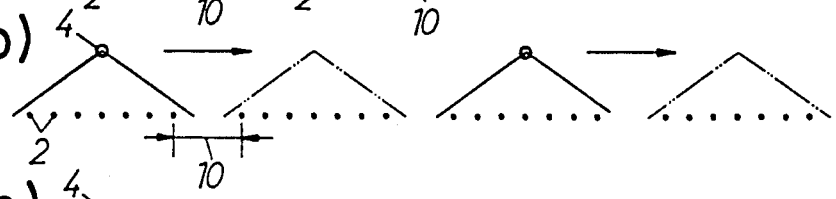
Figure 2C:
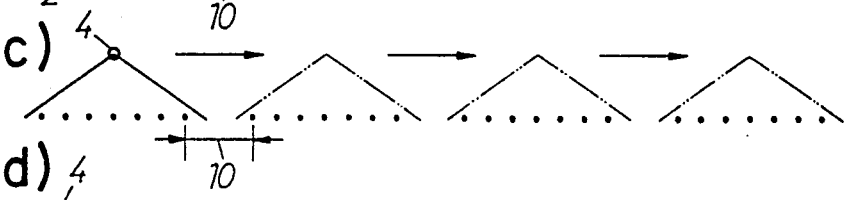
Figure 2D:
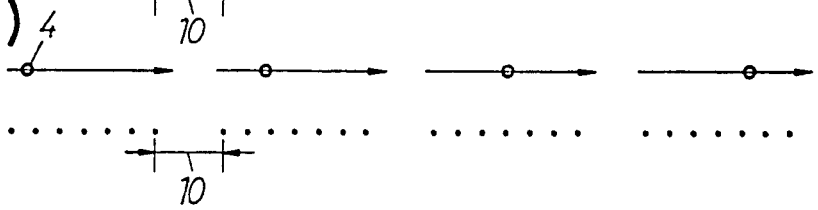

Referring to FIG. 1 showing a yarn breakage detecting system in a first embodiment according to the present invention, warp yarns 2 of a warp are kept apart by a reed 3, and a plurality of yarn detectors 4 are arranged to detect the warp yarns 2 photoelectrically. Each yarn detector 4 may be a fixed image sensor or a movable photoelectric sensor of a reflection type of a transmission type. A yarn detection signal provided by each yarn detector 4 is transferred through a signal converter 5 to a signal processing unit 6, such as a computer. A signal processing unit 6 stores programs for processing signals and is connected to a memory 7, a display 8 and an input unit 9.

In this embodiment, the warps 2 of the warp are divided into four groups as shown in FIG. 2(*a*) by way of example and spaces 10 of a predetermined width are formed between the adjacent groups of warp yarns so that the respective monitoring ranges of the adjacent yarn detectors 4 will not overlap each other.

Each yarn detector 4 may be a fixed yarn detector assigned to each group of warp yarns 2 as shown in FIG. 2(*a*), a moving yarn detector assigned to two groups of warp yarns 2 as shown in FIG. 2(*b*) or a moving yarn detector assigned to each group of warp yarns 2 as shown in FIG. 2(*d*). The yarn breakage detecting system 1 may be provided with a single moving yarn detector for sequentially monitoring the four groups of warp yarns 2 as shown in FIG. 2(*c*).

Figure 3:
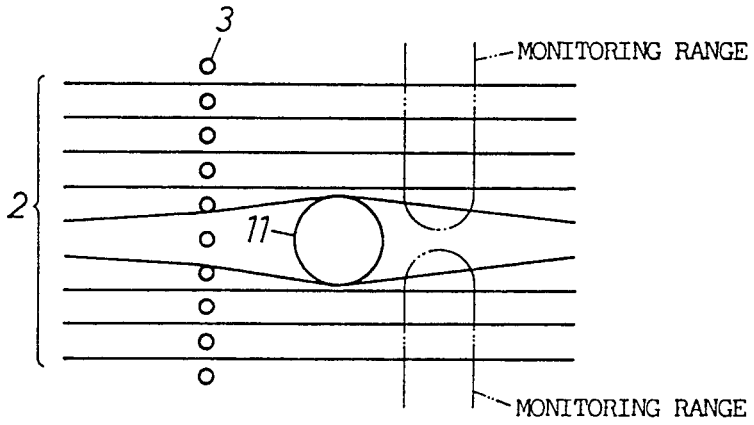
FIG. 3 is a diagrammatic view of assistance in explaining a method of spacing adjacent groups of warp yarns by a predetermined distance.

As stated above, the width of the spaces 10 between the adjacent groups of warp yarns 2 is determined so that the respective monitoring ranges of the adjacent yarn detectors 4 will not overlap each other. The distance 10 is about twice the pitch of the dents of the reed 3. The adjacent groups of warp yarns 2 are separated by spacers 11 as shown in FIG. 3.

Figure 4:
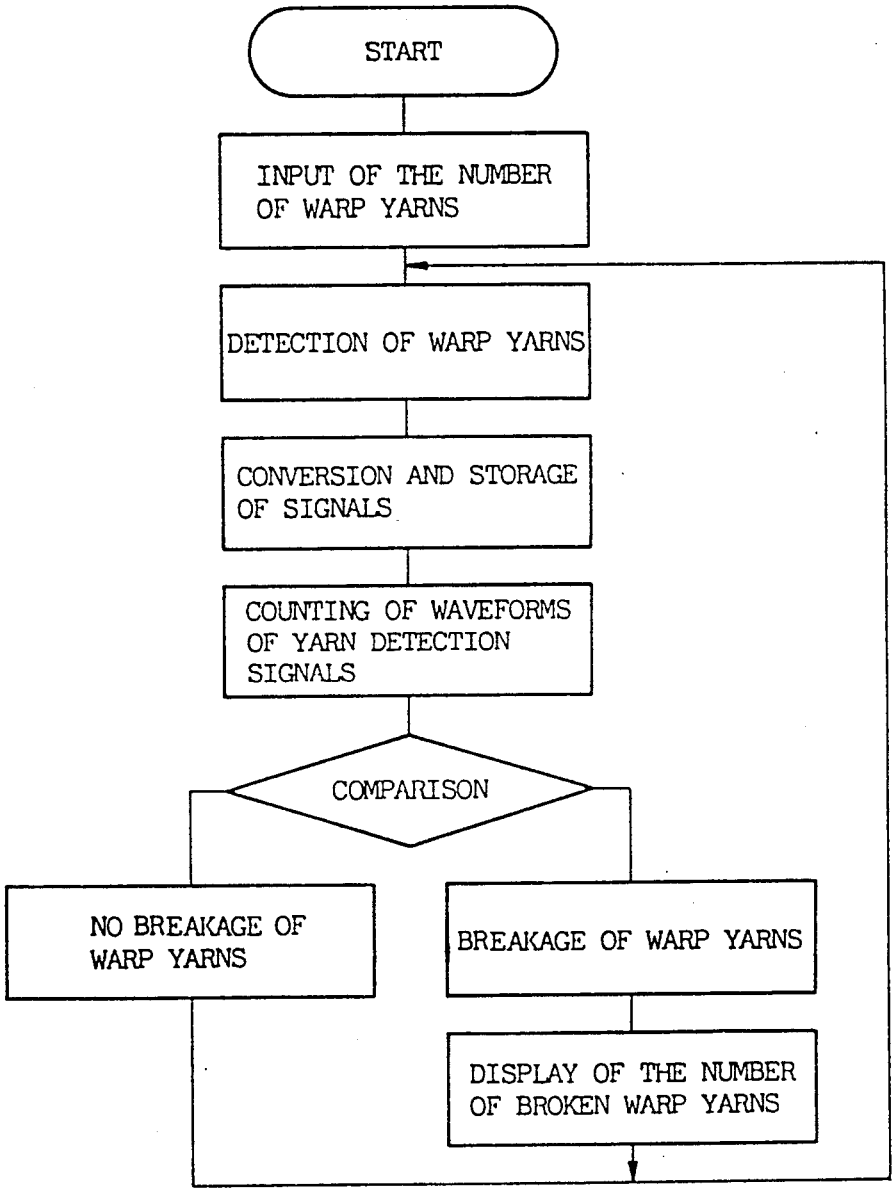
FIG. 4 is a flowchart of a yarn breakage detecting program.
Figure 5A:
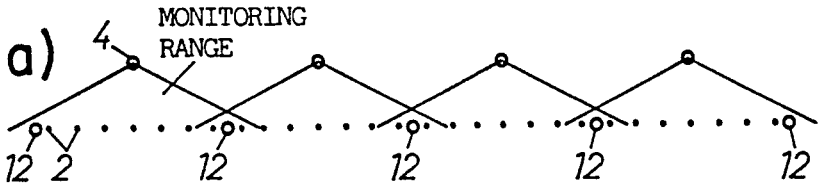
FIGS. 5(*a*) to 5(*d*) are diagrams of assistance in explaining another method of dividing warp yarns of a warp into a plurality of groups.
Figure 5B:
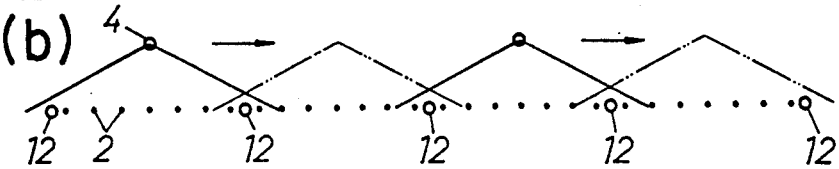
Figure 5C:
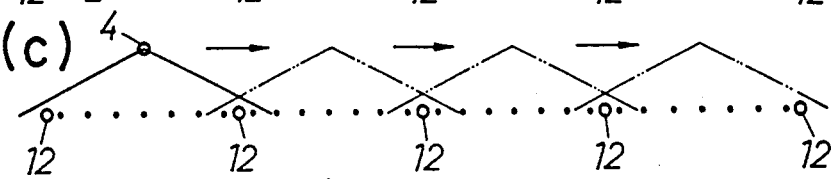
Figure 5D:
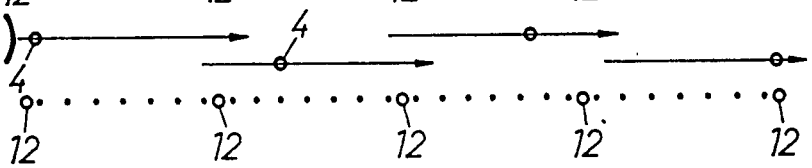

Referring to FIG. 4 showing a program for detecting yarn breakage, a reference number equal to the number of all the warp yarns 2 of the warp or the reference numbers each equal to the number of the warp yarns 2 in each group is set by operating the input unit 9 and the reference number or the reference numbers is stored in the memory 7. Each yarn detector 4 detects the warp yarns 2 in the corresponding group of warp yarns 2 photoelectrically and gives a yarn detection signal to the signal converter 5. The yarn detection signal has, for example, peaks corresponding to the warp yarns 2. The signal converter 5 shapes the waveforms of the yarn detection signals provided by the yarn detectors 4, converts the yarn detection signals into binary pulse signals of a square pulses, and gives the binary pulse signals to the signal processing unit 6. The pulses of each binary pulse signal represent the warp yarns 2 of each group.

Then, the signal processing unit 6 samples the binary pulse signals at a predetermined sampling period, stores the binary pulse signals temporarily in the memory 7, and then counts the numbers of pulses of the binary pulse signals to sum up the numbers of warp yarns 2 in the range detected by the warp yarn detector 4 then sum up the numbers of warp yarns 2 summed up by each warp yarn detectors 4 and compares the total number of warp yarns 2 or the total numbers of warp yarns 2 in the ranges of the warp yarn detectors 4 with the reference number or the reference numbers. It is determined that no warp yarn is broken if the total number of the warp yarns 2 is equal to the reference number, or it is decided that yarn breakage has occurred if the total number of the warp yarn 2 is smaller than the reference number, and then an alarm signal is generated and the reference number of the warp yarns 2, the number of the group to which the broken warp yarn 2 belongs and the numbers of broken warp yarns 2 in the groups of warp yarns 2 are displayed on the display 8. Then, the operator recognizes the number of broken warp yarns 2, repairs the broken warp yarns 2 and resets the signal processing unit 6.

The spacers 11 for forming the spaces 10 may be omitted and the warp yarns 2 may be sleyed so that the groups of warp yarns are in the reed 3 at predetermined intervals between the groups of warp yarns 2.

As shown in FIG. 1(*a*), the outputs of the signal converters 5 are fed to respective counters 100, whose outputs are fed to a summer 101. The output of the summer 101 is fed to a comparator 102 where it is compared with a preselected number input thereto and the result of the comparison is output as the yarn breakage signal. The other elements connected to the processor 6 have been omitted for the sake of clarity.

Second Embodiment

In a yarn breakage detecting system in a second embodiment according to the present invention, warp yarns 2 of a warp are divided into four groups as shown in FIG. 5(*a*) by way of example, identifiers 12 are interposed between the adjacent groups of warp yarns 2, and the respective monitoring ranges of yarn detectors 4 may overlap each other around the identifiers 12.

Figure 6:
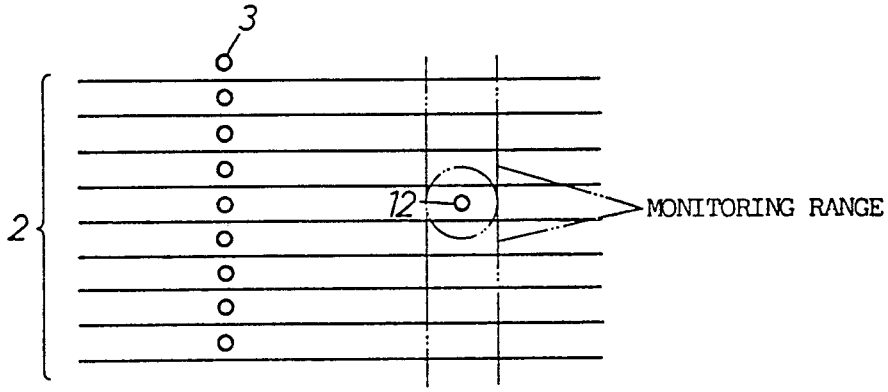
FIG. 6 is a diagrammatic view of assistance in explaining a method of placing an identifier between adjacent groups of warp yarns.

The yarn detectors 4 may be four fixed yarn detectors as shown in FIG. 5(*a*), two moving yarn detectors assigned to the two adjacent groups of warp yarns 2 as shown in FIG. 5(*b*) or four moving yarn detectors assigned respectively to the four groups of warp yarns 2 as shown in FIG. 5(*d*). The yarn breakage detecting system may be provided with a single moving yarn detector that travels in the direction of width of the warp as shown in FIG. 5(*c*). Each identifier 12 is a laser light source disposed at a position corresponding to the space between the end warp yarns 2 of the adjacent groups of warp yarns 2 or a reflecting plate disposed at a position corresponding to the space between the end warp yarns 2 of the adjacent groups of warp yarns 2 as shown in FIG. 6.

Each yarn detector 4, i.e., an image sensor or a photoelectric sensor, detects the warp yarns 2 and the identifiers 12 photoelectrically and generates a yarn detection signal representing the warp yarns 2 and the identifiers 12 disposed at the opposite ends of the corresponding group of warp yarns 2. The yarn detection signal has peaks corresponding to the detected warp yarns 2 and the identifiers 12. The peaks representing the warp yarns 2 and those representing the identifiers 12 can be discriminated from each other from the difference in the height of the peak; the height of the peaks representing the identifiers 12 is greater than that of the peaks representing the warp yarns 2. An identifier detector included in a signal processing unit 6 identifies the peaks representing the identifiers 12 through the comparison of the peaks with a threshold value. Thus, the number of the warp yarns 2 in each group can be determined by counting the number of lower peaks between the higher peaks representing the identifiers 12 in the yarn detection signal provided by each yarn detector 4.

If the yarn detector 4 is an image sensor, the number of the warp yarn 2 can be determined by removing two peaks representing the identifiers 12 at the opposite ends of the strings of peaks of the yarn detection signal and counting the rest of the peaks. If the yarn detector 4 is a photoelectric sensor, the number of the warp yarns 2 can be determined by starting counting peaks after the detection of the first peak representing the identifier 12 in the yarn detection signal and stopping counting peaks upon the detection of the last peak representing the other identifier 12.

In the second embodiment, the identifier 12 may be a space of a size greater than the pitches between the warp yarns formed between the end warp yarns 2 of the adjacent group of warp yarns 2 instead of the laser light source or the reflecting plate. When such a space is used as the identifier 12, the identifier detector determines that an interval between the adjacent peaks greater than those between peaks representing the warp yarns 2 in the same group of warp yarns 2 represents the identifier 12. The number of warp yarns 2 is determined by counting the number of peaks between the spaces greater than those between the peaks representing the warp yarns 2.

The identifier 12 may be a indicating yarn of a color different from that of the warp yarns 2, included in the warp. When such an indicating yarn is used as the identifier 12, a sensor capable of discriminating the color of the indicating yarn from that of the warp yarns 2 must be employed as the yarn detector 4.

The yarn breakage detecting system may be provided with special detectors only for detecting the identifiers 12 in addition to the yarn detectors 4.

Since the respective monitoring ranges of the yarn detectors 4 are demarcated by the identifiers 12, each yarn detector 4 does not count the number of warp yarns 2 of the adjacent groups even if the monitoring ranges of the yarn detectors 4 overlap each other. Therefore, the respective widths of the groups of warp yarns 2 need not be equal to each other even if the yarn detectors 4 are mounted on a single moving member and the respective positions of the yarn detectors 4 on the moving member can be optionally determined; that is, the yarn detectors 4 may be positioned on the moving member so that they move past the limits of the corresponding groups when the range of the movement of the moving member is somewhat wider than the width of the largest one of the monitoring ranges.

Third Embodiment

A yarn breakage detecting system in a third embodiment according to the present invention employs a yarn spacer 14, instead of the reed and the spacer 11, to separate groups of warp yarns 2 by a space 10 of a predetermined width or to form the identifier 12 employed in the second embodiment. The plurality of warp yarns 2 forming a warp and unwound from a warp beam travel via a guide roller 13, the yarn spacer 14 and the monitoring ranges of two yarn detectors 15 toward the cloth beam. The yarn detectors 15 may be of an image analysis type, a reflecting type or a transmission type. Each yarn detector 15 has a monitoring range corresponding to a half of the width of the warp of warp yarns 2. Each yarn detector 15 is mounted on a slide block 20 capable of moving widthwise of the warp along a pair of parallel guide rods 16 extended widthwise of the warp of warp yarns 2. The slide blocks 20 supporting the yarn detector 15 is driven for movement at a predetermined speed along the guide rods 16 by a driving mechanism comprising a feed nut 24 integrally combined with the slide block 20, a screw shaft 17 and a motor 18 in addition to the guide rods 16.

The yarn spacer 14 is disposed behind the yarn detector 15, and the guide roller 13 is disposed behind and near the yarn spacer 14 with respect to the direction of travel of the warp yarns 2 to restrain the warp yarns 2 from vertical swing motion so that the warp yarns 2 are held in a region in which the warp yarns 2 can be detected by the yarn detector 15. The guide roller 13 may be disposed in front of and near the yarn spacer 14.

The yarn spacer 14 is a comb-like member consisting of an elongate base plate 40 extended widthwise of the warp of warp yarns 2, a plurality of parallel spacing pins 41 arranged at equal intervals on the base plate 40 so as to extend perpendicularly to the base plate 40, and a plurality of demarcating pins 42 arranged at the same intervals as that of the spacing pins 41. The pitches of the spacing pins 41 and the demarcating pins 42 are determined so that the warp yarns 2 are not allowed to move horizontally, depending on the number of warp yarns 2, the width of the warp of warp yarns 2 and the type of the warp yarns 2.

Figure 8:
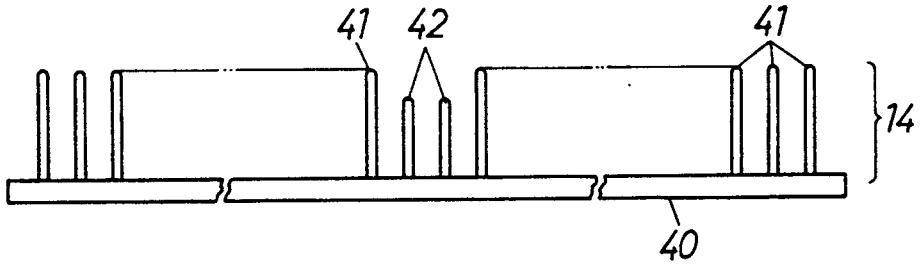
FIGS. 8 to 17 are enlarged fragmentary views of yarn spacers.
Figure 9:
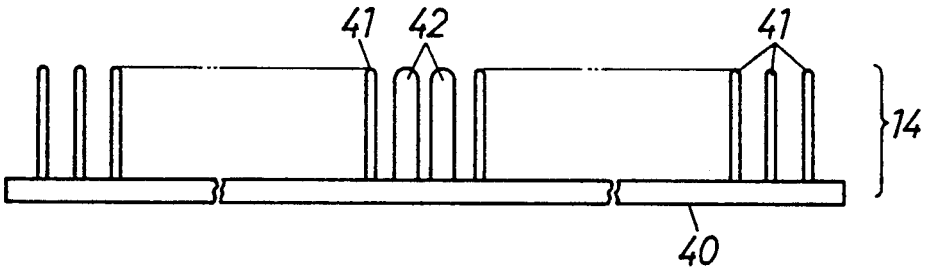
Figure 10:
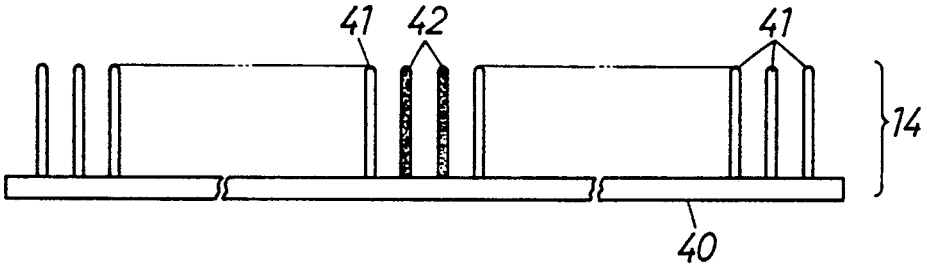

The demarcating pins 42 can be visually discriminated from the spacing pins 41, that is, the demarcating pins 42 are shorter than the spacing pins 41 as shown in FIG. 8 (or longer than the spacing pins 41), the demarcating pins 42 are thicker than the spacing pins 41 as shown in FIG. 9 (or thinner than the spacing pins 41), the demarcating pins 42 are colored partly or entirely in a color different from that of the spacing pins 41 as shown in FIG. 10, or the demarcating pins 42 are formed of a material different from that forming the spacing pins 41.

Figure 11:
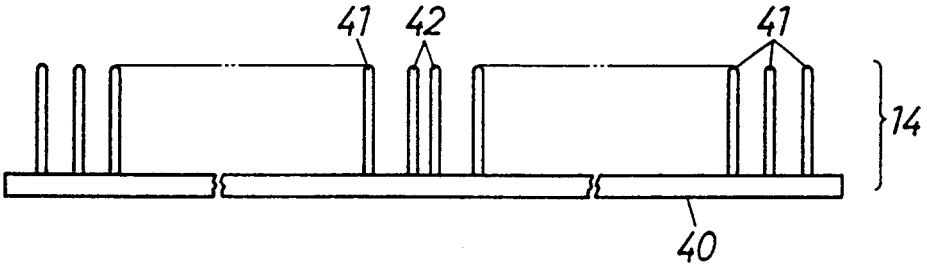
Figure 12:
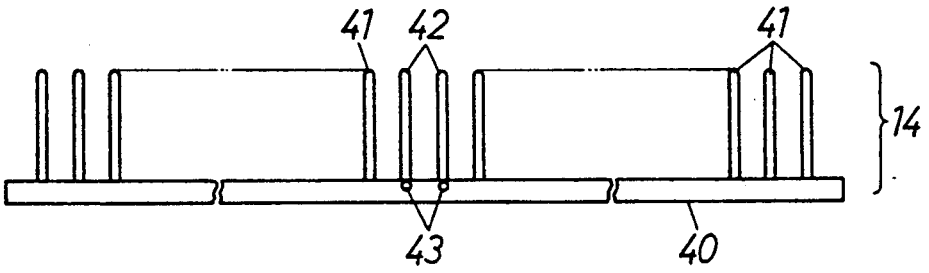
Figure 13:
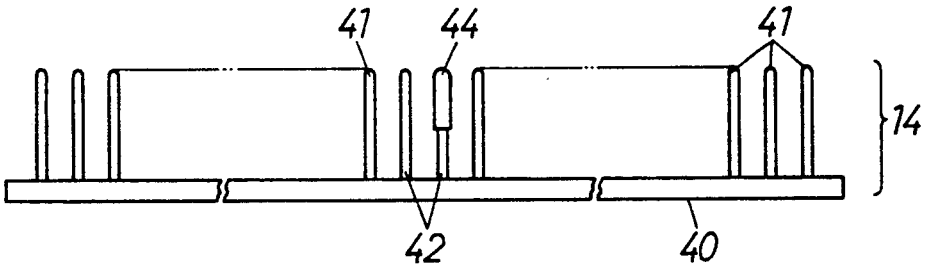
Figure 14:
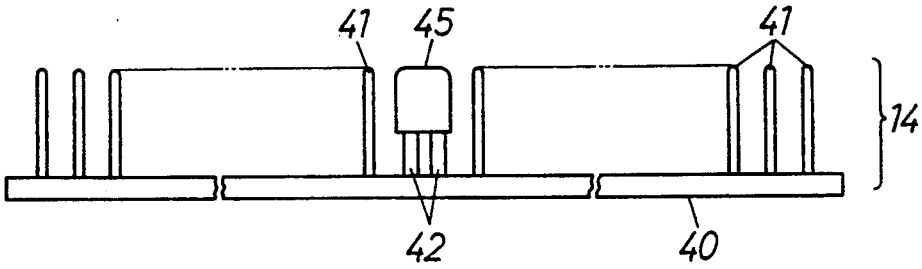

To enable the visual discrimination of the demarcating pins 42 from the spacing pins 41, the demarcating pins 42 may be arranged at pitches different from those of the spacing pins 41 as shown in FIG. 11, projections 43 may be formed on the base plate 40 at positions corresponding to the demarcating pins 42 as shown in FIG. 12, a cap 44 may be put on one of the successive demarcating pins 42 as shown in FIG. 13, or a cap 45 may be put on the successive demarcating pins 42 as shown in FIG. 14. The caps 44 and 45 may be colored to further facilitate the visual discrimination of the demarcating pins 42 from the spacing pins 41.

Generally, the position of the visually distinguishable identifier is determined to demarcate the monitoring ranges of the yarn detectors 15, to divide the warp yarns 2 into groups, to demarcate the group of the warp yarns 2 of a type and the group of the warp yarns 2 of another type or to facilitate finding the position of a broken warp yarn 2.

The pitch between some of the warp yarns 2 can be changed to demarcate the adjacent groups of warp yarns 2, for example, by skipping over the space between the short demarcating pins 42 when passing the warp yarns sequentially through the spaces between the adjacent spacing pins 41 of the yarn spacer 14. Since the demarcating pins 42 can be readily found, the groups of warp yarns 2 can be readily discriminated from each other.

When the warp yarns 2 are divided into a plurality of groups by the space 10 in the first embodiment, it is possible to skip over the space between the short demarcating pins 42 when passing the warp yarns 2 sequentially through the spaces between the adjacent spacing pins 41 of the yarn spacer 14. The spaces 10 can be readily found.

Figure 7:
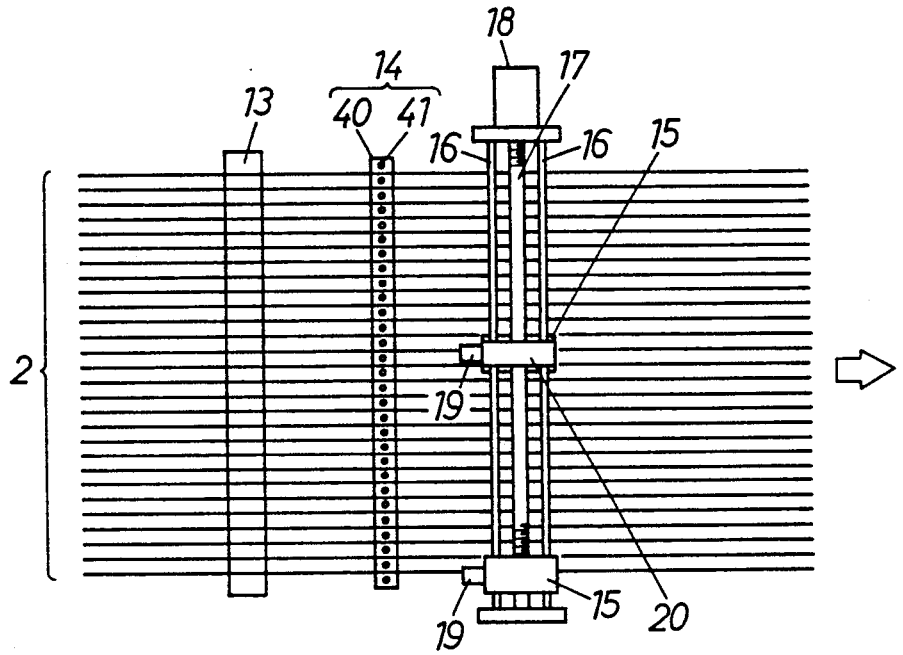
FIG. 7 is a plan view of a yarn guiding device.

When counting the number of warp yarns 2 by moving each of the two yarn detectors 15 through a distance greater than the width of the corresponding half section of the warp of warp yarns 2 in the direction of width of the warp and the yarn detectors 15 are assigned respectively to the half sections of the warp as in the second embodiment, the boundary between the half sections of the warp to which the yarn detectors 15 are assigned respectively can be readily recognized, for example, by the demarcating pins 42 of a color different from that of the spacing pins 41 disposed at a position on the yarn spacer 14 corresponding to the middle of the warp with respect to the width of the warp. As shown in FIG. 7, a photoelectric sensor 19 specially for detecting the demarcating pins 42 is mounted on the slide block 20 supporting the yarn detector 15.

When warp yarns 2 of different types in each group of warp yarns 2 need to be divided into subgroups, the subgroups of the warp yarns 2 of different types can be easily demarcated by putting caps 45 on the spacing pins 41 at the boundaries between the subgroups in each group of warp yarns 2 separated by the demarcating pins 42 from the adjacent groups of warp yarns 2.

Figure 15:
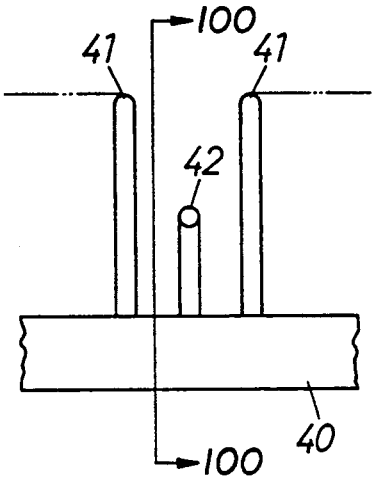
Figure 16:
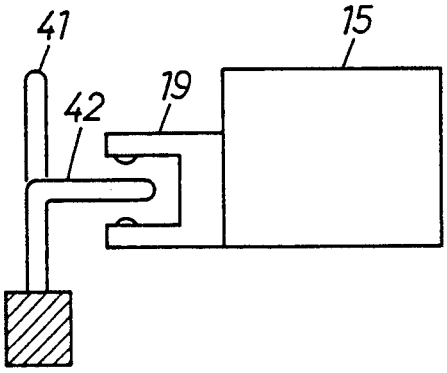
Figure 17:
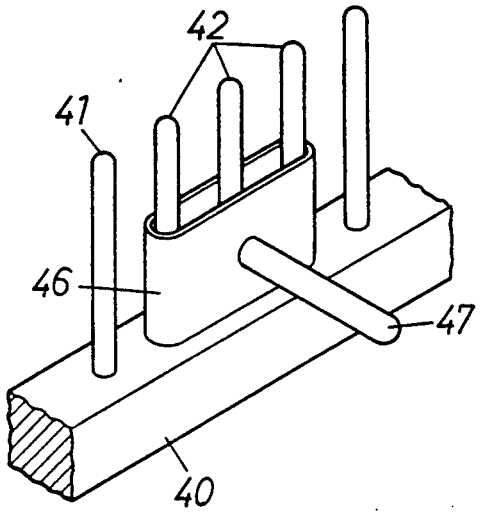

It is also possible to detect the boundary between the adjacent groups of warp yarns 2 by placing an L-shaped demarcating pin 42, which is different from the spacing pins 41 in shape, between the adjacent spacing pins 41 and detecting the horizontal portion of the demarcating pin 42 by a sensor 19 of a transmission type as shown in FIGS. 15 and 16. It is also possible to detect the boundary between the adjacent groups of warp yarns 2 by placing straight demarcating pins 42 between the spacing pins 41, putting a cap 46 having a projection 47 on the demarcating pin 42 and detecting the projection 47 by the sensor 19 of a transmission type. The positive detection of the horizontal portion of the L-shaped demarcating pin 42 or the projection 47 of the cap 46 enables further reliable detection of the boundary between the groups of warp yarns 2 respectively corresponding to the respective monitoring ranges of the yarn detectors 15. It is effective to form a wide space between the groups by skipping over a position corresponding to the pin 42 so that the yarn detector 15 will not erroneously detect the warp yarns 2 of the adjacent group before the sensor 19 detects the pin 42.

When the position number of a broken warp 2, i.e., the number of the broken warp 2 as counted from a reference position, such as one of the selvedges or the middle warp yarn 2, is detected by the yarn detector 15, the operator is able to locate the broken warp yarn 2 easily by counting the spacing pins 41 with reference to the position of the demarcating pin 42. Accordingly, it is desirable to arrange the demarcating pins 42, for example, every tenth spacing pins 41 or every predetermined distance.

One or more than two demarcating pin 42 may be placed at a position corresponding to the boundary between the adjacent groups of warp yarns 2 instead of two demarcating pins 42.

Figure 18:
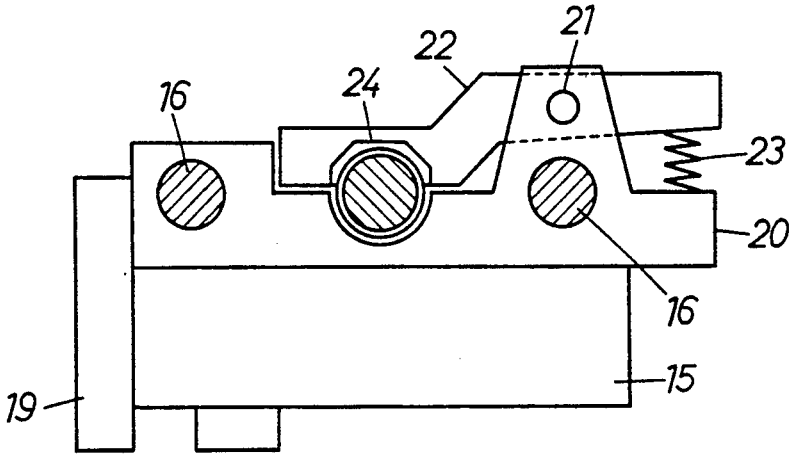
FIG. 18 is a side view of a holding mechanism of the detecting unit of the yarn breakage detecting system.

FIG. 18 shows a support mechanism for supporting the yarn detector 15 and the sensor 19 shown in FIG. 7. The support mechanism is attached to the lower surface of each slide block 20 supported for sliding on the two guide rods 16. It is also possible to attach the support mechanism to the side surface of the slide block 20. The support mechanism has a holding lever 22 pivotally supported on horizontal pin 21 supported on one end of the slide block 20. A half nut 24, namely, one of the halves of a split nut, is attached to one end of the a holding lever 22, and the half nut 24 is pressed against the upper half of the screw shaft 17 by a compression spring 23. When the other end of the holding lever 22 is depressed, the half nut 24 is raised from the upper half of the screw shaft 17 and disengaged from the screw shaft 17 to enable the free movement of the slide block 20 along the two guide rods 16. Thus, the slide blocks 20 can be freely moved along the guide rods 16 in determining or changing the distance between the yarn detectors 15 according to the position of the boundary between the groups of warp yarns 2.

Figure 19:
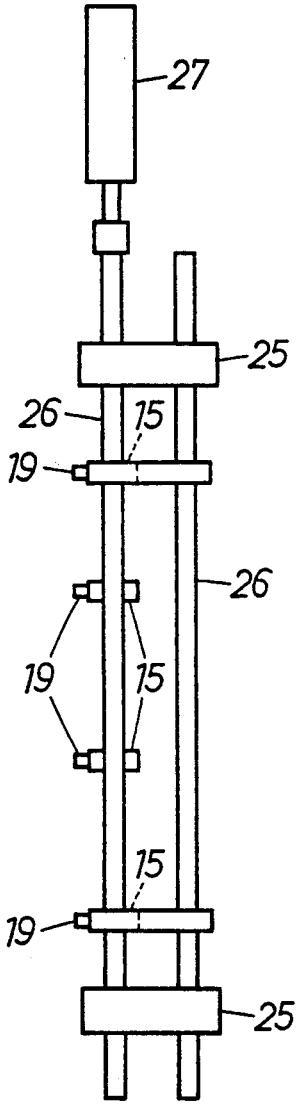
FIG. 19 is a plan view of another guiding mechanism.

FIG. 19 shows a reciprocating mechanism for reciprocating the yarn detectors 15 and the sensors 19. The reciprocating mechanism has a pair of parallel slide shafts 26 extended across the warp of warp yarns 2, support blocks 25 supporting the slide shafts 26, and a pneumatic actuator 27 connected to one of the slide shaft 26 to drive the slide shaft 26 for reciprocation. The yarn detectors 15 and the sensors 19 are attached to the slide shafts 26 so as to correspond to the groups of warp yarns 2, respectively, and to be reciprocated in ranges corresponding to the groups of warp yarns 2, respectively.

Figure 20:
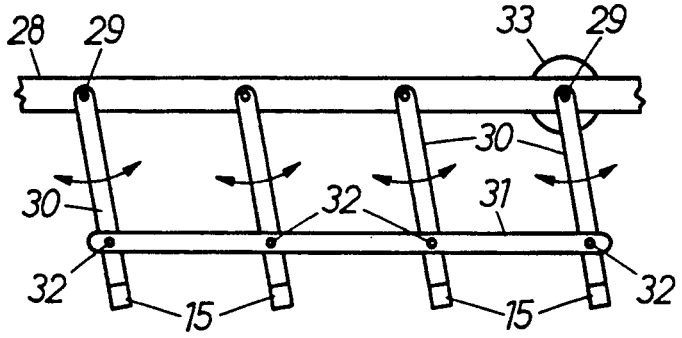
FIG. 20 is a side view of the third guiding mechanism.

FIG. 20 shows another reciprocating mechanism of a parallel linkage type. This reciprocating mechanism comprises a frame 28, a plurality of links 30 pivotally supported for swing motion by pins 29 on the frame 28, and a connecting link 31 pivotally connected by pins 32 to the links 30. The yarn detectors 15 and the sensors 19 are attached to the free ends of the links 30. One of the links 30 is driven for swing motion by a motor 33 to reciprocate the yarn detectors 15 and the sensors 19. Since all the yarn detectors 15 can be reciprocated by a single driving means, i.e., the motor 33, the reciprocating mechanism can be easily adjusted.

Although a determination that a yarn breakage has occurred may be made when the counted number of the warp yarns is smaller than the preset value, a determination that the yarn breakage has occurred may be made when successive counted numbers of the warp yarns are smaller than the preset value to surely detect yarn breakage.

Although the invention has been described in its preferred forms with a certain degree of particularity, obviously any changes and variations are possible therein. It is therefore to be understood that the present invention may be practiced otherwise than as specifically described herein without departing from the scope and spirit thereof.

What is claimed is:

1. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns by a provided dividing means so that adjacent groups of warp yarns are spaced apart by a predetermined distance greater than pitches of said warp yarns in said groups, and wherein said yarn detectors are disposed so as to be assigned respectively to correspond to said groups of warp yarns and respective monitoring ranges of said yarn detectors are preselected so as to respectively correspond to said groups of warp yarns, and wherein said signal processing unit is disposed so as to count said peaks in said electrical yarn detection signal of each of said yarn detectors; and wherein said signal processing unit includes means for counting the warp yarns in accordance with signals from each of said yarn detectors and further includes a means for summing the counted number of warp yarns and includes a means for comparing the sum with a preselected number and for outputting a yarn breakage signal in accordance with said comparison.

2. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns, and wherein identifiers are disposed in boundaries between adjacent groups, and wherein identifier detectors are provided for detecting said identifiers and for providing identifier detection signals, and wherein each yarn detector is disposed so that a preselected monitoring range thereof includes said warp yarns of a corresponding group and said identifiers disposed at opposite ends of said same group, and wherein said yarn detection signals and said identifier detection signals provided by said yarn detectors and said identifier detectors are supplied to said signal processing unit, and wherein said signal processing unit is disposed so as to count said number of peaks in each yarn detection signal between two successive identifier detection signals; and wherein said signal processing unit includes a means for counting the warp yarns in accordance with signals from each of said yarn detectors and further includes a means for summing the counted number of warp yarns and includes a means for comparing the sum with a preselected number and for outputting a yarn breakage signal in accordance with said comparison.

3. A warp in combination with yarn breakage detecting system according to claims 1 or 2, wherein said yarn detectors are fixed at positions respectively corresponding to said groups of warp yarns.

4. A warp in combination with yarn breakage detecting system according to claims 1 or 2, wherein the warp yarns of the warp are divided into a plurality of groups, wherein said yarn detectors are moved widthwise of the warp by a yarn detector moving means.

5. A warp in combination with yarn breakage detecting system according to claim 4, wherein said yarn detector moving means comprises: a pair of parallel guide rods extended widthwise of the warp of warp yarns; slide blocks slidably supported on said guide rods; a screw shaft extended in parallel to said guide rods; a half nut attached to said slide blocks so as to engage said screw shaft; and a motor for rotating said screw shaft.

6. A warp in combination with yarn breakage detecting system according to claim 4, wherein said yarn detector moving means comprises: a pair of support blocks; a pair of slide shafts supported on said support blocks for sliding in directions along the width of the warp of warp yarns; and a pneumatic actuator for reciprocating one of said slide shafts.

7. A warp in combination with yarn breakage detecting system according to claim 4, wherein said yarn detector moving means comprises: a frame extended widthwise of the warp of warp yarns; a plurality of links pivotally supported respectively by pins parallel to the warp yarns on said frame; a connecting link pivotally joined by pins to said plurality of links; and a motor for driving one of said plurality of links for effecting a swing motion.

8. A warp in combination with yarn breakage detecting system according to claims 1 or 2, wherein the warp yarns are divided into a plurality of groups of warp yarns by a yarn spacer having spacing pins, and demarcating pins for demarcating said groups of warp yarns, for being visually discriminated by said pins.

9. A warp in combination with yarn breakage detecting system according to claim 8, wherein said demarcating pins have a shape which is different from that of said spacing pins.

10. A warp in combination with yarn breakage detecting system according to claim 8, wherein said demarcating pins have a color which is different from that of said spacing pins.

11. A warp in combination with yarn breakage detecting system according to claim 8, wherein successive demarcating pins have pitches which are different from those of said spacing pins.

12. A warp in combination with yarn breakage detecting system according to claim 8, wherein each of said demarcating pins includes a cap disposed thereon.

13. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarns detection signals, representing the warp yarns and for providing a yarn breakage detection signal when a counted number of peaks is smaller than a predetermined number;

wherein said warp yarns of said warp are divided into a plurality of groups of warp yarns by a provided dividing means so that adjacent groups of warp yarns are spaced apart by a predetermined distance greater than pitches of said warp yarns in said groups, and wherein said yarn detectors are disposed so as to be assigned respectively to correspond to said groups of warp yarns and the respective monitoring ranges of said yarn detectors are preselected so as to respectively correspond to said groups of warp yarns, and wherein said signal processing unit is disposed so as to count said peaks in said electrical yarn detection signal of each of said yarn detectors;

and wherein said yarn detectors are moved widthwise of the warp by a yarn detector moving means;

and wherein said yarn detector moving means comprises: a pair of parallel guide rods extended widthwise of the warp of warp yarns; slide blocks slidably supported on aid guide rods; a screw shaft extended in parallel to said guide rods; a half nut attached to said slide blocks so as to engage said screw shaft; and a motor for rotating said screw shaft.

14. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns by a provided dividing means so that adjacent groups of warp yarns are spaced apart by a predetermined distance greater than pitches of said warp yarns in said groups, and wherein said yarn detectors are disposed so as to be assigned respectively to correspond to said groups of warp yarns and the respective monitoring ranges of said yarn detectors are preselected so as to respectively correspond to said groups of warp yarns, and wherein said signal processing unit is disposed so as to count said peaks in said electrical yarn detection signal of each of said yarn detectors;

and wherein said yarn detectors are moved widthwise of the warp by a yarn detector moving means;

and wherein said yarn detector moving means comprises: a pair of support blocks; a pair of slide shafts supported on said support blocks for sliding in directions along the width of the warp of warp yarns; and a pneumatic actuator for reciprocating one of said slide shafts.

15. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns by a provided dividing means so that adjacent groups of warp yarns are spaced apart by a predetermined distance greater than pitches of said warp yarns in said groups, and wherein said yarn detectors are disposed so as to be assigned respectively to correspond to said groups of warp yarns and the respective monitoring ranges of said yarn detectors are preselected so as to respectively correspond to said groups of warp yarns, and wherein said signal processing unit is disposed so as to count said peaks in said electrical yarn detection signal of each of said yarn detectors;

and wherein said yarn detectors are moved widthwise of the warp by a yarn detector moving means;

and wherein said yarn detector moving means comprises: a frame extended widthwise of the warp of warp yarns; a plurality of links pivotally supported respectively by pins parallel to the warp yarns on said frame; a connecting link pivotally joined by pins to said plurality of links; and a motor, for driving one of said plurality of links for effecting a swing motion.

16. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns, and wherein identifiers are disposed in boundaries between adjacent groups, and wherein identifier detectors are provided for detecting said identifiers and for providing identifier detection signals, and wherein each yarn detector is disposed so that a preselected monitoring range thereof includes said warp yarns of a corresponding group and said identifiers disposed at opposite ends of said same group, and wherein said yarn detection signals and said identifier detection signals provided by said yarn detectors and said identifier detectors are supplied to said signal processing unit, and wherein said signal processing unit is disposed so as to count said number of peaks in each yarn detection signal between two successive identifier detection signals; and wherein said yarn detectors are moved widthwise of the warp by a yarn detector moving means; and wherein said yarn detector moving means comprises: a pair of parallel guide rods extended widthwise of the warp of warp yarns; slide blocks slidably supported on said guide rods; a screw shaft extended in parallel to said guide rods; a half nut attached to said slide blocks so as to engage said screw shaft; and a motor for rotating said screw shaft.

17. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns, and wherein identifiers are disposed in boundaries between adjacent groups, and wherein identifier detectors are provided for detecting said identifiers and for providing identifier detection signals, and wherein each yarn detector is disposed so that a preselected monitoring range thereof includes said warp yarns of a corresponding group and said identifiers disposed at opposite ends of said same group, and wherein said yarn detection signals and said identifier detection signals provided by said yarn detectors and said identifier detectors are supplied to said signal processing unit, and wherein said signal processing unit is disposed so as to count said number of peaks in each yarn detection signal between two successive identifier detection signals; and wherein said yarn detectors are moved widthwise of the warp by a yarn detector moving means; and wherein said yarn detector moving means comprises: a pair of support blocks; a pair of slide shafts supported on said support blocks for sliding in directions along the width of the warp of warp yarns; and a pneumatic actuator for reciprocating one of said slide shafts.

18. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns, and wherein identifiers are disposed in boundaries between adjacent groups, and wherein identifier detectors are provided for detecting said identifiers and for providing identifier detection signals, and wherein each yarn detector is disposed so that a preselected monitoring range thereof includes said warp yarns of a corresponding group and said identifiers disposed at opposite ends of said same group, and wherein said yarn detection signals and said identifier detection signals provided by said yarn detectors and said identifier detectors are supplied to said signal processing unit, and wherein said signal processing unit is disposed so as to count said number of peaks in each yarn detection signal between two successive identifier detection signals; and wherein said yarn detectors are moved widthwise of the warp by a yarn detector moving means; and wherein said yarn detector moving means comprises: a frame extended widthwise of the warp of warp yarns; a plurality of links pivotally supported respectively by pins parallel to the warp yarns on said frame; a connecting link pivotally joined by pins to said plurality of links; and a motor, for driving one of said plurality of links for effecting a swing motion.

19. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns by a provided dividing means so that adjacent groups of warps yarns are spaced apart by a predetermined distance greater than pitches of said warp yarns in said groups, and wherein said yarn detectors are disposed so as to be assigned respectively to correspond to said groups of warp yarns and the respective monitoring ranges of said yarn detectors are preselected so as to respectively correspond to said groups of warp yarns, and wherein said signal processing unit is disposed so as to count said peaks in said electrical yarn detection signal of each of said yarn detectors; and wherein the warp yarns are divided into a plurality of groups of warp yarns by a yarn spacer having spacing pins, and demarcating pins for demarcating said groups of warp yarns, for being visually discriminated by said pins.

20. A warp in combination with yarn breakage detecting system according to claim 19, wherein said demarcating pins have a shape which is different from that of said spacing pins.

21. A warp in combination with yarn breakage detecting system according to claim 19, wherein said demarcating pins have a color which is different from that of said spacing pins.

22. A warp in combination with yarn breakage detecting system according to claim 19, wherein successive demarcating pins have pitches which are different from those of said spacing pins.

23. A warp in combination with yarn breakage detecting system according to claim 19, wherein each of said demarcating pins includes a cap disposed thereon.

24. A warp in combination with a yarn breakage detecting system comprising:

a plurality of yarn detectors for photoelectrically detecting parallel warp yarns forming a warp and for providing electrical yarn detection signals; and a signal processing unit for counting peaks in said electrical yarn detection signals, representing the warp yarns and for providing a yarn breakage detection signal when a counted number of peaks is smaller than a predetermined number;

wherein said warp yarns of said warp are divided into a plurality of groups of warp yarns and wherein identifiers are disposed in boundaries between adjacent groups, and wherein identifier detectors are provided for detecting said identifiers and for providing identifier detection signals, and wherein each yarn detector is disposed so that a preselected monitoring range thereof includes said warp yarns of a corresponding group and said identifiers disposed at opposite ends of said same group, and wherein said yarn detection signals and said identifier detection signals provided by said yarn detectors and said identifier detectors are supplied to said signal processing unit, and wherein said signal processing unit is disposed so as to count said number of peaks in each yarn detection signal between two successive identifier detection signals; and wherein the warp yarns are divided into a plurality of groups of warp yarns by a yarn spacer having spacing pins, and demarcating pins for demarcating said groups of warp yarns, for being visually discriminated by said pins.

25. A warp in combination with yarn breakage detecting system according to claim 24, wherein said demarcating pins have a shape which is different from that of said spacing pins.

26. A warp in combination with yarn breakage detecting system according to claim 24, wherein said demarcating pins have a color which is different from that of said spacing pins.

27. A warp in combination with yarn breakage detecting system according to claim 24, wherein successive demarcating pins have pitches which are different from those of said spacing pins.

28. A warp in combination with yarn breakage detecting system according to claim 24, wherein each of said demarcating pins includes a cap disposed thereon.

* * * * *